US008267439B2

(12) United States Patent
Fay

(10) Patent No.: US 8,267,439 B2
(45) Date of Patent: Sep. 18, 2012

(54) APPARATUS AND METHOD FOR TYING A NECKTIE

(76) Inventor: Philip Fay, Overland Park, KS (US)

( * ) Notice: Subject to any disclaimer, the term of this patent is extended or adjusted under 35 U.S.C. 154(b) by 0 days.

(21) Appl. No.: 13/285,625

(22) Filed: Oct. 31, 2011

(65) Prior Publication Data

US 2012/0131724 A1 May 31, 2012

Related U.S. Application Data

(63) Continuation of application No. 12/412,028, filed on Mar. 26, 2009, now Pat. No. 8,047,580.

(60) Provisional application No. 61/043,960, filed on Apr. 10, 2008, provisional application No. 61/086,177, filed on Aug. 5, 2008.

(51) Int. Cl.
*B65H 69/04* (2006.01)

(52) U.S. Cl. ..... 289/1.5

(58) Field of Classification Search ..... 289/1.5, 289/17, 18.1; D2/609; 2/145, 156
See application file for complete search history.

(56) References Cited

U.S. PATENT DOCUMENTS

| | | | |
|---|---|---|---|
| 2,244,692 | A | 6/1941 | Hall |
| 2,316,002 | A | 4/1943 | Koivisto |
| 2,470,973 | A | 5/1949 | Bovee |
| D236,859 | S | 9/1975 | Wada |
| 3,999,222 | A | 12/1976 | Walborn |
| 5,170,507 | A | 12/1992 | Langford et al. |
| 5,416,926 | A | 5/1995 | Koy |
| 5,584,075 | A | 12/1996 | Bae et al. |
| 5,774,893 | A | 7/1998 | Torres |
| 5,983,461 | A | 11/1999 | Chen |
| 6,094,746 | A | 8/2000 | Miller |
| 6,120,068 | A | 9/2000 | DiPietro |
| 6,490,763 | B2 | 12/2002 | Tamura |
| 6,920,642 | B2 | 7/2005 | Dickens |
| 8,047,580 | B2 * | 11/2011 | Fay ..... 289/17 |
| 2008/0084066 | A1 | 4/2008 | Palos |

FOREIGN PATENT DOCUMENTS

| | | | |
|---|---|---|---|
| DE | 19509671 | A1 | 7/1996 |
| JP | 1045805 | A | 2/1989 |
| WO | 9827838 | A1 | 7/1998 |

OTHER PUBLICATIONS

Zipper Tie—Google Image Search dated at http://images.google.com/images?hl=en&q=zipper+tie&um=1&ie=UTF-8&sa+N&tab=wi, dated Apr. 6, 2008, 2 pages.

Tie Guide.com "Necktie Knots: Windsor Knot" at http://www.tieguide.com/windsor.htm, 3 pages 2003.

* cited by examiner

*Primary Examiner* — Shaun R Hurley
(74) *Attorney, Agent, or Firm* — Gerry J. Elman; Elman Technology Law, P.C.

(57) ABSTRACT

An apparatus and method for tying a Windsor knot. In particular, an apparatus and method for tying a Windsor knot for a necktie, with the knot being symmetric, and the tie hanging straight and of proper length for the wearer or the necktie. The apparatus and method are universal for neckties, not requiring a special necktie to be used in conjunction with the apparatus and method.

1 Claim, 9 Drawing Sheets

APPARATUS AND METHOD FOR TYING A NECKTIE

RELATED APPLICATIONS

This application is a Continuation of commonly owned U.S. patent application Ser. No. 12/412,028, entitled: Apparatus and Method for Tying a Necktie, filed Mar. 26, 2009 (U.S. Pat. No. 8,047,580), which is related to and claims priority from commonly owned U.S. Provisional Patent Application Ser. No. 61/043,960, entitled: Apparatus and Method for Tying a Necktie, filed Apr. 10, 2008, and commonly owned U.S. Provisional Patent Application Ser. No. 61/086,177, entitled: Apparatus and Method for Tying a Necktie, filed Aug. 5, 2008; the disclosures of all three applications are incorporated by reference in their entirety herein.

TECHNICAL FIELD

The disclosed subject matter is directed to apparatus and methods for tying knots, and in particular to tying a Windsor knot for a necktie with the knot being symmetric, the tie hanging straight, and of the proper length on the wearer.

BACKGROUND

Ties such as neckties have been associated with men's dress for centuries. While numerous knots for neckties are known, one of the most common knots for tying a necktie is a Windsor knot. The Windsor knot is a wide triangular knot that is usually worn for business and formal occasions, and this type of knot should be worn with wide spread collar shirts.

Additionally, when tying the necktie to make the Windsor knot, the wearer has to be conscious of two things. First, the Windsor knot must be of a certain size and symmetry, so the necktie does not hang sideways on the wearer. Second, the positioning of the knot must be such that the length of the necktie is proper, whereby the rear side does not extend longer than the front side, or the front side does not extend too low on the wearer.

When tying a necktie, the wearer (user), especially if not familiar with wearing a necktie, typically makes several attempts, before their Windsor knot is acceptable and the necktie length is proper. Such multiple attempts to properly tie the necktie are a waste of time and are a common source of frustration. Accordingly, tying a necktie is essentially a hit or miss proposition.

While one solution is the clip-on necktie, clip-on neckties exhibit drawbacks. These neckties are usually for children. Additionally, these neckties carry a social stigma of the wearer being less sophisticated, and due to the limited range of styles for clip-on neckties, the wearer lacking a sense of fashion.

SUMMARY

The disclosed subject matter is directed to an apparatus and method for typing a proper Windsor knot in a necktie, with the knotted necktie being at the correct length. The Windsor knot is also symmetric and accurate. Also, the user of the apparatus may use their own tie, allowing for an endless number of neckties to be used, such that the apparatus is universal for neckties.

An embodiment of the disclosed subject matter is directed to an apparatus for facilitating tying of a necktie. The apparatus includes a tubular member including oppositely disposed first and second lateral sides and oppositely disposed front and rear sides. There is a first slot in the tubular member at the first lateral side and a second slot in the tubular member at the second lateral side. The first slot and the second slot are positioned at least proximate to the rear side of the tubular member, and are, for example, on the rear side of the tubular member. The tubular member has an inner cavity and the first slot and the second slot include inner and outer edges. A panel extends in the inner cavity, attaching to the tubular member at the rear side proximate to an inner edge of one slot and proximate to an outer edge of the other slot. The panel dividing the inner cavity into a plurality of areas, and may be, for example, curved concavely with respect to the rear side.

The tubular member includes a main portion and extension portions, extending from the main portion. These extension portions may be at each of the lateral sides of the tubular member, such that each of the slots extends along at least a portion of each extension portion and at least a portion of the main portion. The tubular member is open at its upper and lower ends, and may be continuous, enclosing the inner cavity between the open upper and lower ends, or discontinuous and open, partially enclosing while still defining the inner cavity, between the open upper and lower ends.

The aforementioned apparatus may be formed of multiple pieces or sections, for example, two pieces or sections that are separable from each other. The pieces are such that each piece includes cooperating structure for engaging and retaining the pieces in an engagement when the pieces are joined together.

BRIEF DESCRIPTION OF THE DRAWINGS

Attention is now directed to the drawing figures, where like or corresponding numerals indicate like or corresponding components. In the drawings.

DETAILED DESCRIPTION OF THE DRAWINGS

Figure 1:
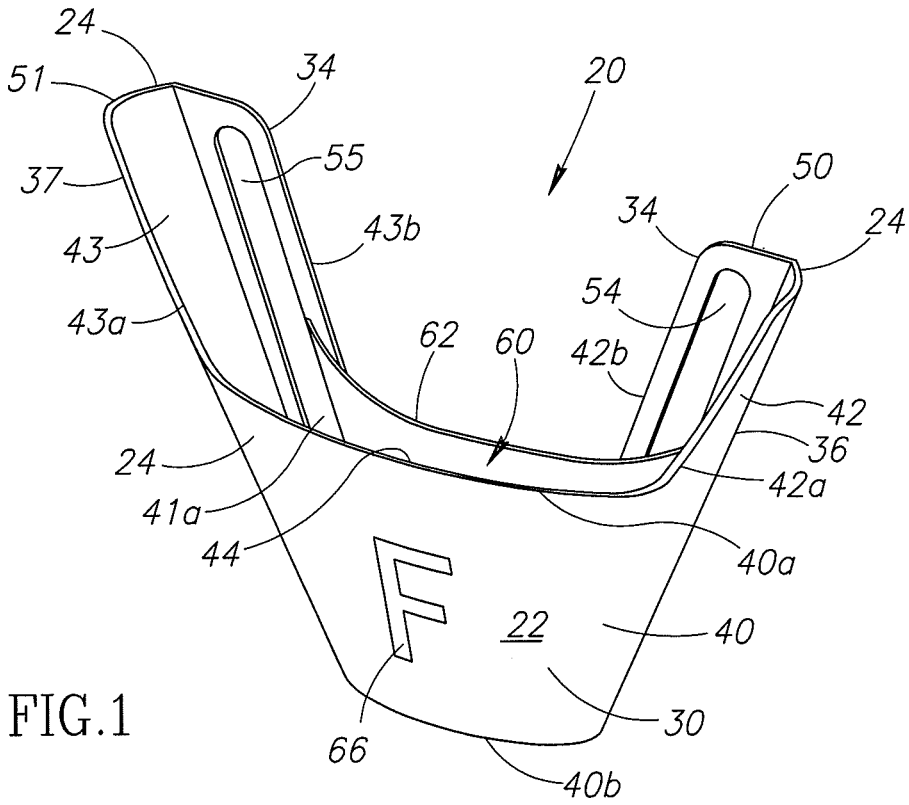
FIG. 1 is a front perspective view of the apparatus in accordance with the disclosed subject matter.
Figure 2:
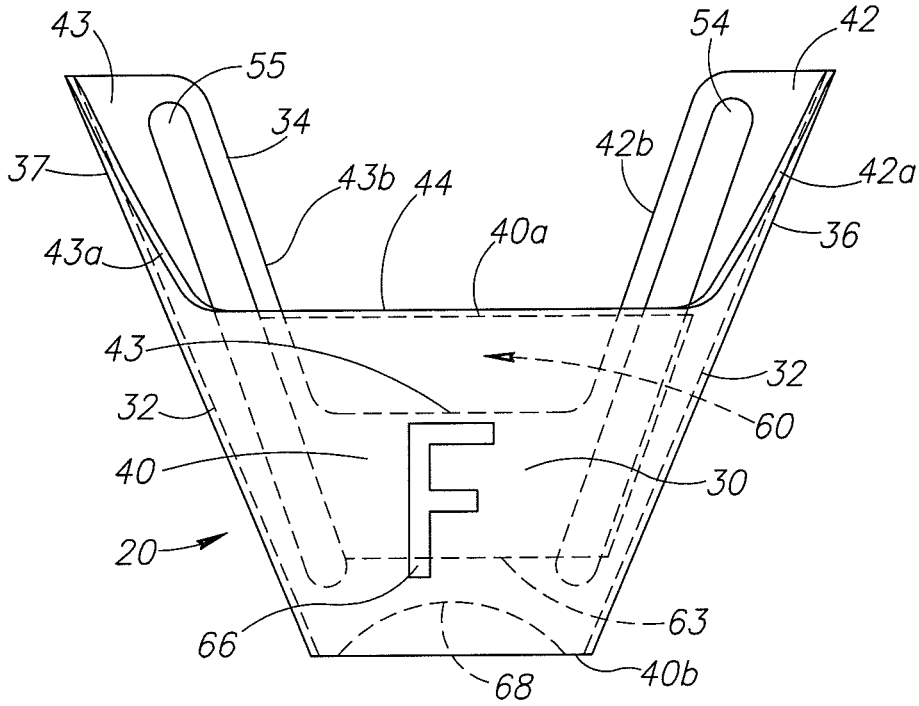
FIG. 2 is a front view of the apparatus of FIG. 1.
Figure 3:
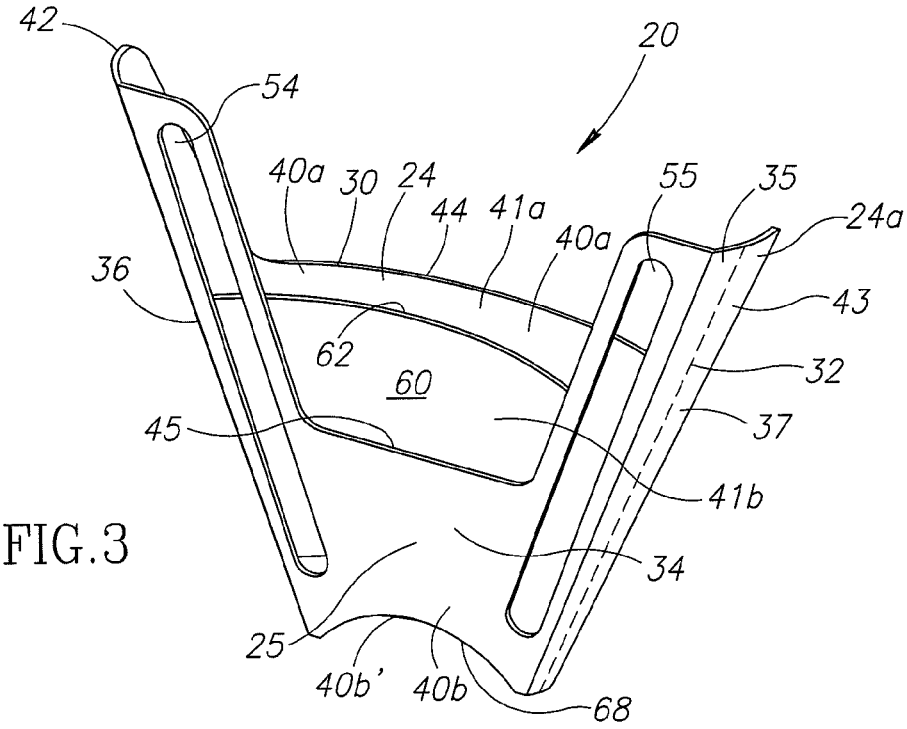
FIGS. 3 and 4 are rear perspective views of the apparatus of FIG. 1.
Figure 4:
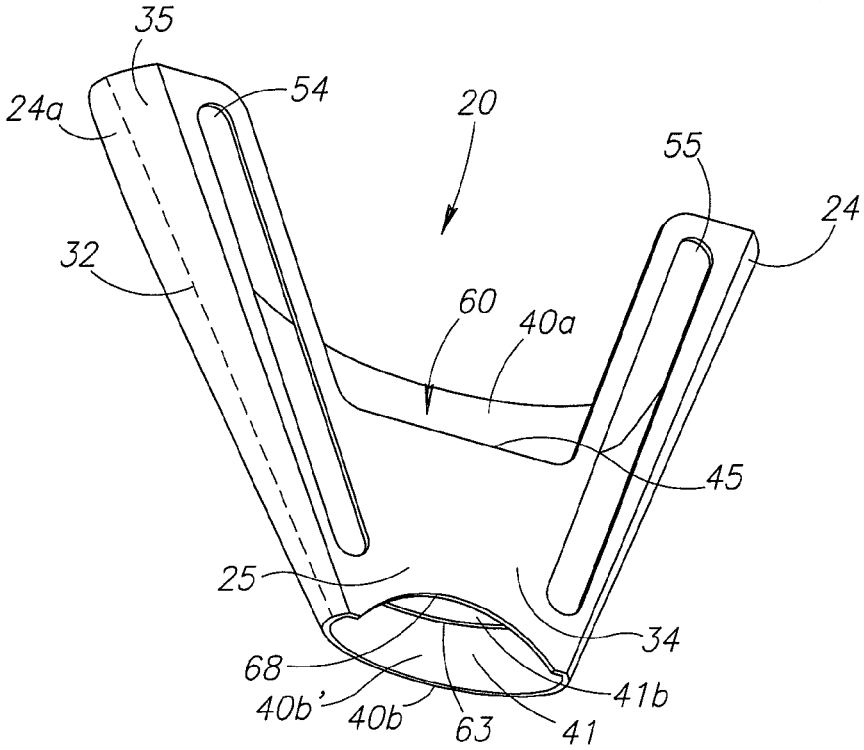
Figure 5:
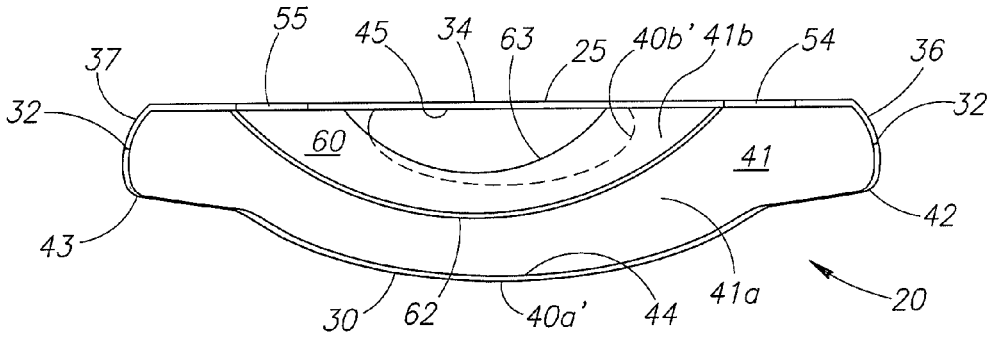
FIG. 5 is a top view of the apparatus of FIG. 1.

In this document, references are made to directions, such as upper, lower, top, bottom, up, down, upward, downward, front, rear, forward, rearward, above, below, and variations thereof. These directional references are exemplary, to show the disclosed subject matter in a typical orientation, and are in no way limiting.

FIGS. 1-5 show an apparatus 20 in accordance with the disclosed subject matter. The apparatus 20 includes a body 22, that is, for example, tubular. The tubular configuration is formed of, for example, a rounded portion 24, that is, for example, oval-like, and a straight portion 25, and is, for example, cone-like in shape. A first or front side 30 of the body 22 is formed by the oval-like rounded portion 24 (the oval-like rounded portion 24 including rounded sub-portions

24*a*, that extend to forward on the arms 42, 43 from the change point of the curvature (indicated by the broken lines 32, shown for emphasis only) and referred to hereinafter as the "curvature change point"), while a second or rear side 34 is shown by straight potion 25 and the rounded sub-portions 35 (of the oval-like portion 24), that extend from the curvature change point 32 to the straight portion 25. Lateral sides 36 (right, based on the view of FIG. 1), 37 (left, based on the view of FIG. 1) of the body 22 are defined, for example, by each respective curvature change point 32.

The body 22 includes a main portion 40, with arms (extensions) 42, 43 extending outward, for example, diagonally outward, from the main portion 40. The main portion 40 is open at its upper 40*a* and lower 40*b* ends (with their respective openings 40*a*', 40*b*'), and an inner cavity 41 is defined therein.

On the first or front side 30, the arms 42, 43 and the main portion 40 define a first or front central edge 44 between lateral edges 42*a*, 43*a*, while on the rear side 34, the arms 42, 43 define a second or rear central edge 45 between lateral edges 42*b*, 43*b*. For example, the first central edge 44 is at a higher elevation than the second central edge 45. Alternately, these edges 44, 45 may be of the same height. The arms 42, 43 terminate in upper edges 50, 51 between the respective lateral edges 42*a*, 42*b*, 43*a*, 43*b*.

Slots 54 (first), 55 (second) are cut into the body 22 at the respective lateral sides 36, 37, and at the second or rear side 34. For example, the slots 54, 55 are cut in the straight portion 25. The slots 54, 55 are openings and extend, for example, diagonally, from proximate to the lower end 40*b* of the body 20, to proximate the upper edges 50, 51. This extension, coupled with the width of the slots 54, 55, provides sufficient space for a necktie to pass through the slots 54, 55, into and out of the body 20, without becoming wrinkled or otherwise damaged.

Alternately, the slots 54, 55 may be in the rounded portions of the second or rear side 34. These slots 54, 55 should be positioned, for example, on the second or rear side 34, to originate at or beyond the curvature change points 32, so as not to be visible from the front (first or front side 30) of the apparatus 20.

A dividing panel or divider 60 is within the inner cavity 41, dividing the inner cavity into portions 41*a*, 41*b*. The dividing panel 60 attaches to the inner side of the main portion 40 of the body 22, proximate to an outer side of the first slot 54 and proximate to the inner side of the second slot 55. The dividing panel 60 is, for example, curved forward, and, for example, runs the length or approximately the length of the main portion 40, from upper end 40*a* to lower end 40*b*, from an upper edge 62 (at or close to the same elevation as the central edge 44) to a lower edge 63 (proximate to the opening 40*b*' at the lower end 40*b*).

Alternately, the dividing panel 60 may attach to the outer side of the main portion 40 of the body 22, proximate to an inner side of the first slot 54 and proximate to the outer side of the second slot 55. In other alternates, the dividing panel 60 need not be present in the apparatus 20.

The body may include indicia, such as an "F" 66 (for "front") on the front side 30 and a notch 68 or the like on the rear side 34, to allow the user to properly orient the apparatus 20, upon use. Additionally, the straight portion 25 of the second rear side 34, allows the second rear side 34 to keep the necktie flat and sit flat against the wearer. The body 22 may be any other tubular shape or configuration desired, provided it can accommodate a necktie. The opening 40*a*' at the upper end 40*a* of the main portion 40 is of a larger area than the opening 40*b*' at the lower end 40*b*, with the openings being, for example, coaxial.

While the apparatus 20 as shown and described above has a body 22 of a closed or continuous tubular structure, such that the inner cavity 41 is completely enclosed by the body 22 between the openings 40*a*' and 40*b*', alternate embodiments may be such that the body 22 of the apparatus 20 may also be of an open or discontinuous tubular structure, such that the inner cavity 41 would be partially enclosed between the openings 40*a*', 40*b*'. In these alternate embodiments, a portion of the rear side 34, for example, the straight portion 25 between the slots 54, 55, need not be present, and would be removed (such that the apparatus 20 would be open at its rear side 34). The inner cavity 41 would not be fully enclosed between the openings 40*a*', 40*b*', but like the apparatus 20, would be defined by the shape of the body 22. The dividing panel 60 would serve to divide the inner cavity 41 into the above-described portions 41*a*, 41*b*.

The apparatus 20 may be made of materials, such as plastic, metal or the like, by conventional plastic or metal molding techniques. The apparatus 20 may be a unitary member, or formed of several pieces. The apparatus 20 may also be made of paper, for example, of multiple pieces.

Reference is now made to FIGS. 6A-6I that detail an exemplary operation of the apparatus 20. Reference is also made to FIGS. 1-5, that detail the apparatus 20. The apparatus 20 will be described with respect to a standard necktie, for example, having a front side and a rear side, with the rear side typically including folded over portions. The necktie, for example, also includes a narrow end that tapers outward to a wide end.

Figure 6A:
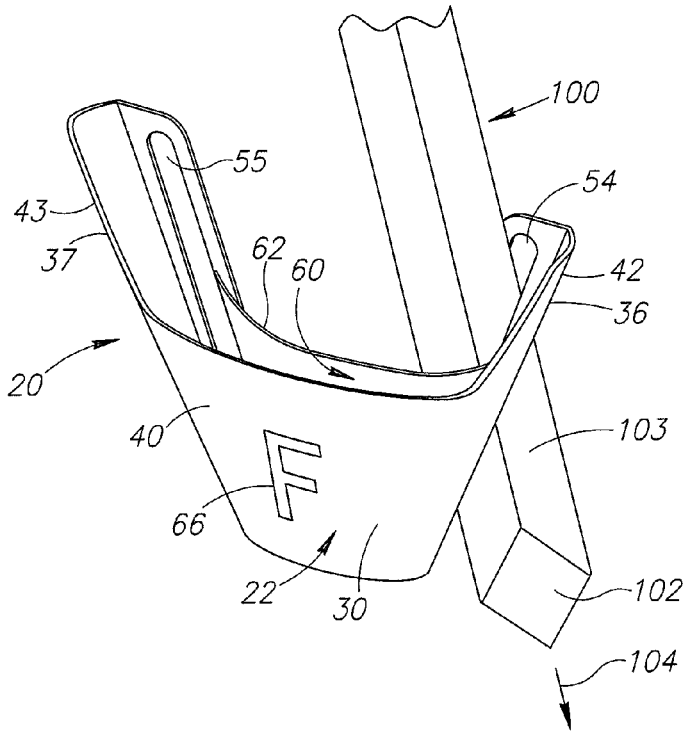
FIGS. 6A-6I are perspective views showing an exemplary operation of the apparatus of FIGS. 1-5.

As shown in FIG. 6A, the apparatus 20 is oriented such that the front side 30, indicated by "F" 66 is forward. The necktie 100 at its narrow end 102, with the rear side 103 facing forward, is placed through the first slot 54. The necktie 100 is pulled downward, in the direction of the arrow 104.

Figure 6B:
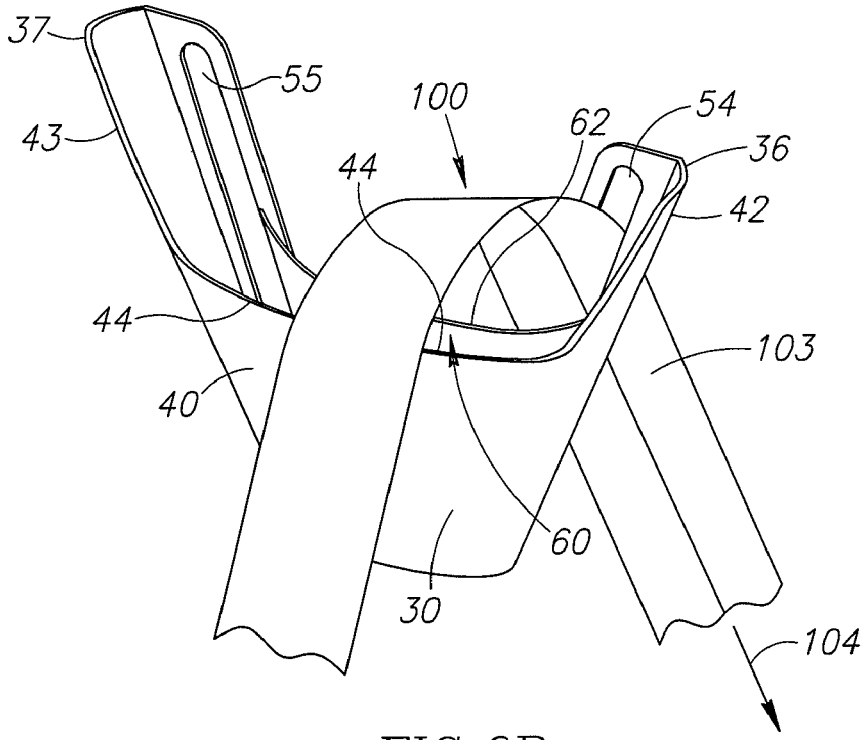
Figure 6C:
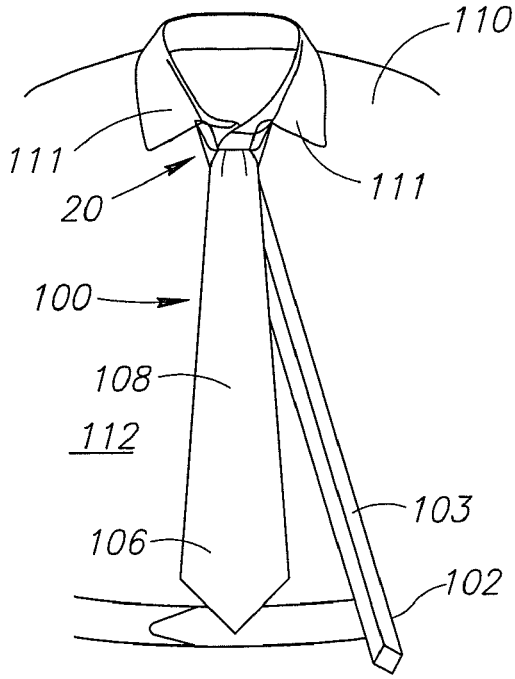

The narrow end 102 of the necktie 100 continues to be pulled downward, in the direction of the arrow 104, and the remaining portion of the necktie 100 is draped over the divider panel 60 (over the upper edge 62) and the first central edge 44, as shown in FIG. 6B. The apparatus 20 with the necktie 100 is placed proximate to, and preferably flush with, the shirt 110 where the collar 111 comes together. Downward pulling of the narrow end 102 of the necktie 100 continues until the wide end 106 of the necktie 100, at the front side 108 is at the proper length with respect to the user's body 112, as shown in FIG. 6C. The straight portion 25 that defines a portion of the rear side 34 of the apparatus 20 may be rested against the shirt 110.

Figure 6D:
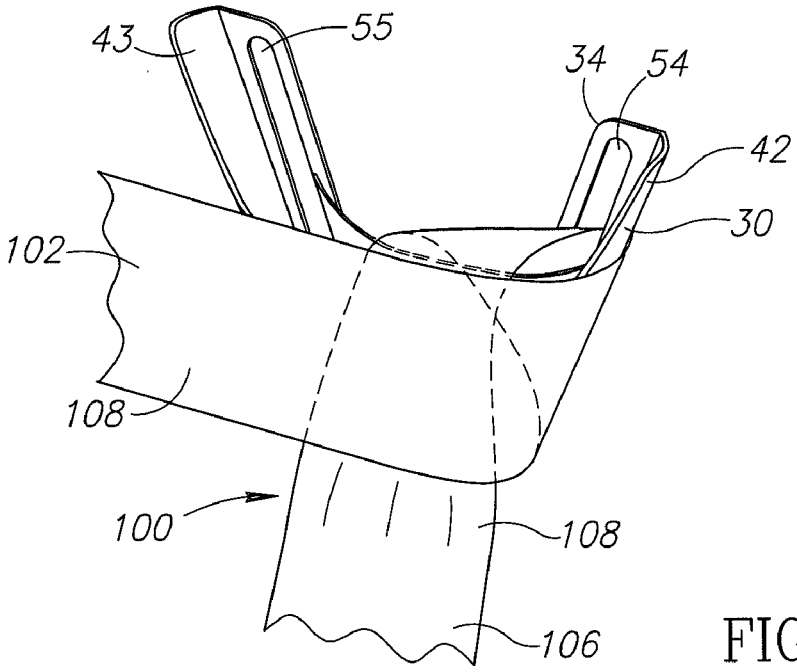

Moving to FIG. 6D, the narrow end 102 of the necktie 100 is oriented such that its front side 108 is facing forward, and it is brought over the front side 30 of the apparatus 20. This movement coupled with the width of the necktie 100 covers over the central edge 44 of the apparatus 20.

Figure 6E:
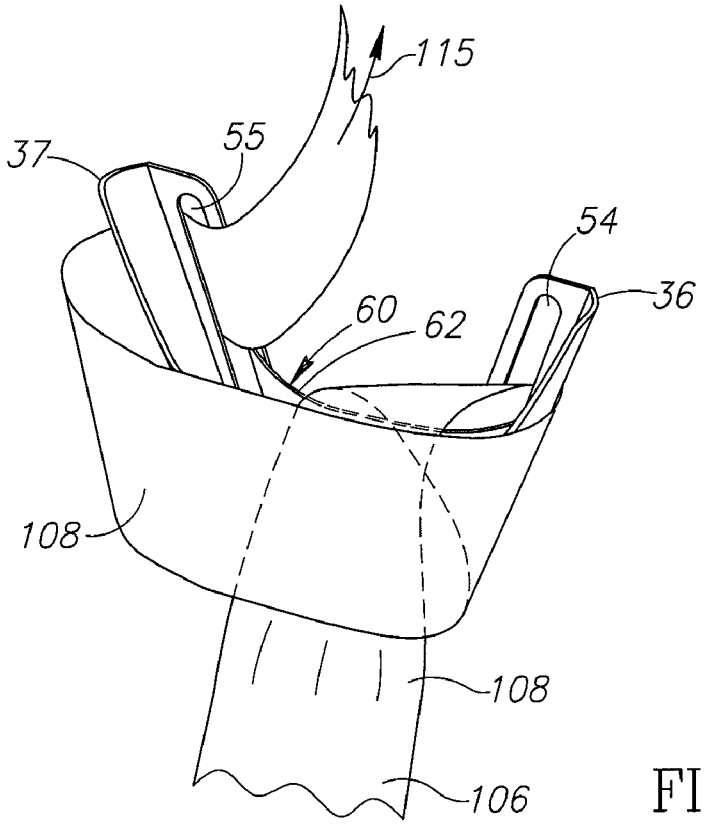
Figure 6F:
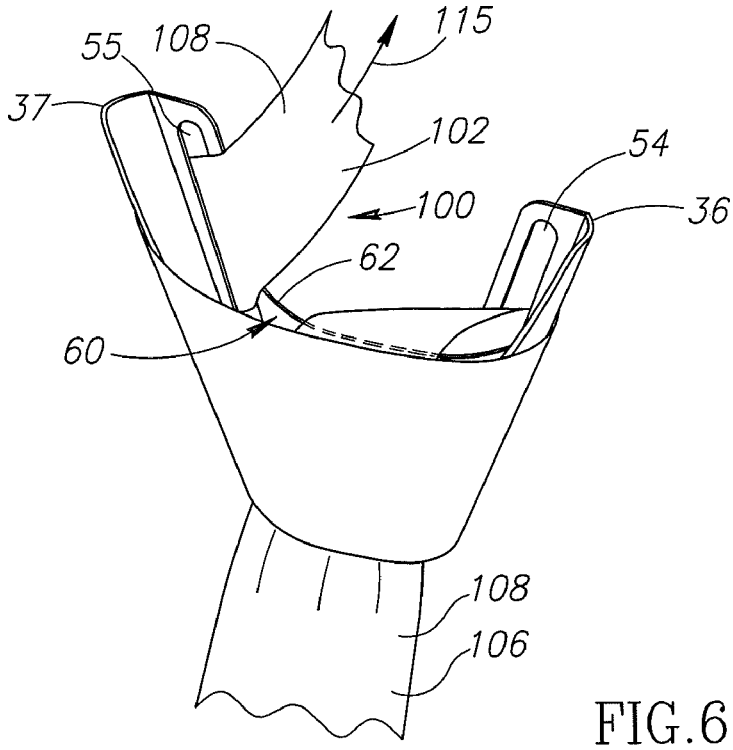
Figure 6G:
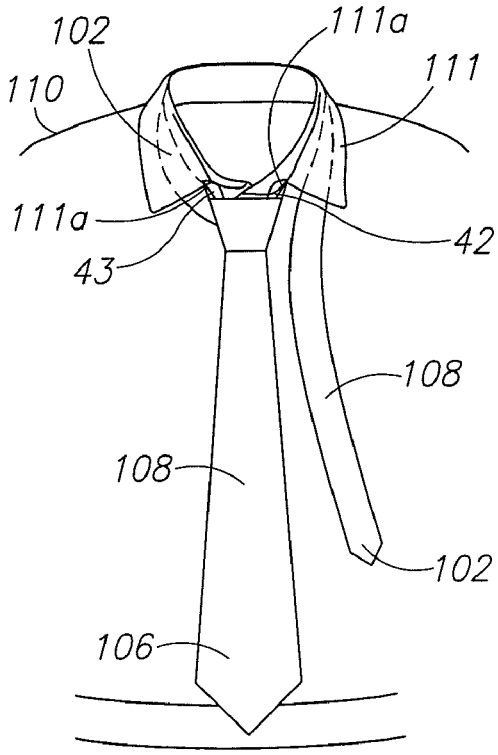

The narrow end 102 is brought through the second slot 55, and moved outward, in the direction of the arrow 115, as shown in FIG. 6E. Continued pulling of the narrow end 102 of the necktie 100 in the direction of the arrow 115, causes the necktie 100 to tighten around the apparatus 20, as shown in FIG. 6F. The narrow end 102 is pulled around the collar 111, while the apparatus 20 remains in contact with the shirt 110, such that the arms 42, 43 extend into the collar openings 111*a*, as shown in FIG. 6G.

Figure 6H:
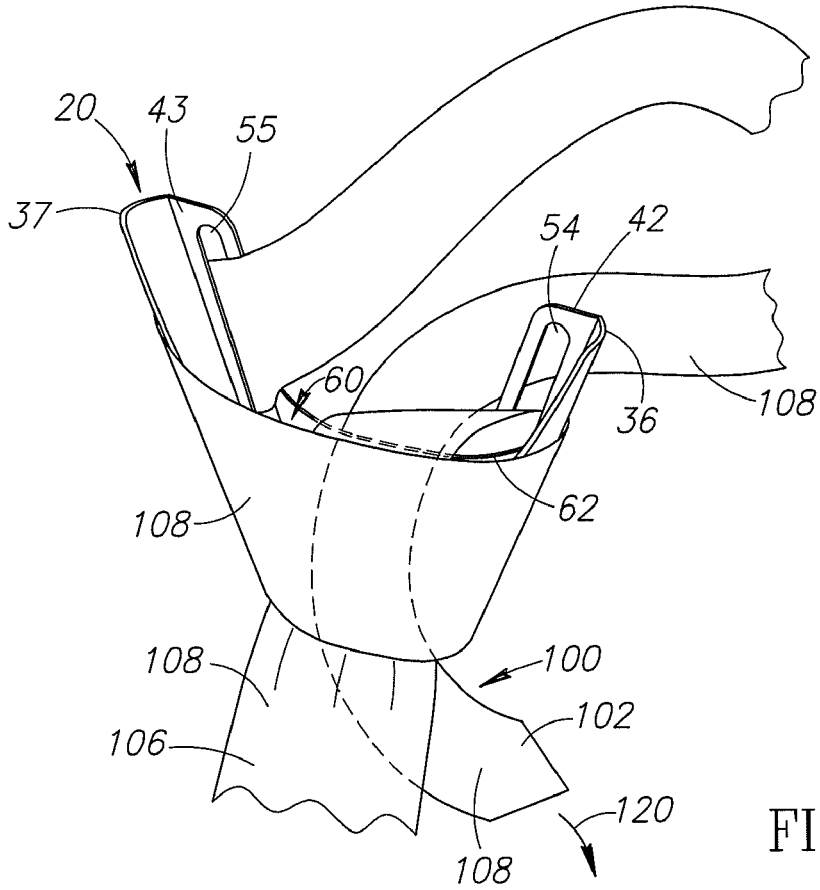
Figure 6I:
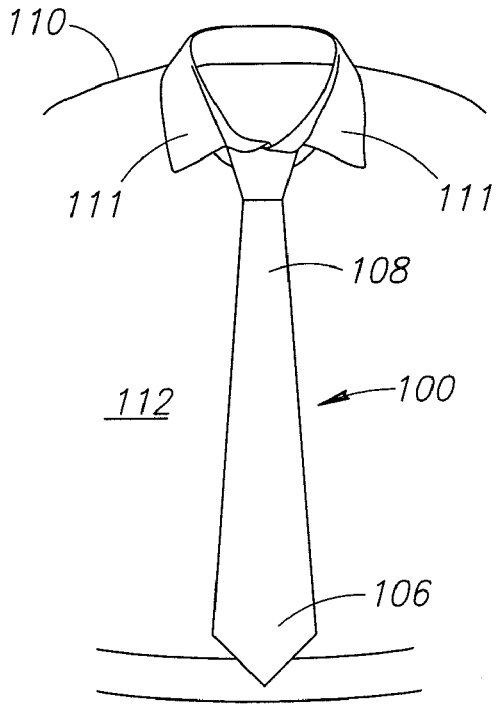

The narrow end 102 of the necktie 100, is then brought through the opening 40*a*' of the main portion 40, from outside the lateral side 36, and into the cavity portion 41*b*. The narrow end 102 is pulled through the cavity portion 41*b*, through the opening 40*b*' and then downward, in the direction of the arrow 120, as shown in FIG. 6H. The apparatus 20 with the necktie, now in a proper Windsor knot on it, may be moved upward so that the arms 42, 43 are in the collar 111 and the apparatus 20 with the knotted necktie 100 is flush with the collar 111 at the junction of the collar portions of the shirt 110. Minor adjustments may be made by pulling downward on the narrow end 102, either before, after or simultaneous with the upward movement of the apparatus 20. FIG. 6I shows the necktie 100 and collar 111 completely covering the apparatus 20, with the apparatus in its final position with the necktie 100 in a proper Windsor knot on the apparatus 20.

Figure 7A:
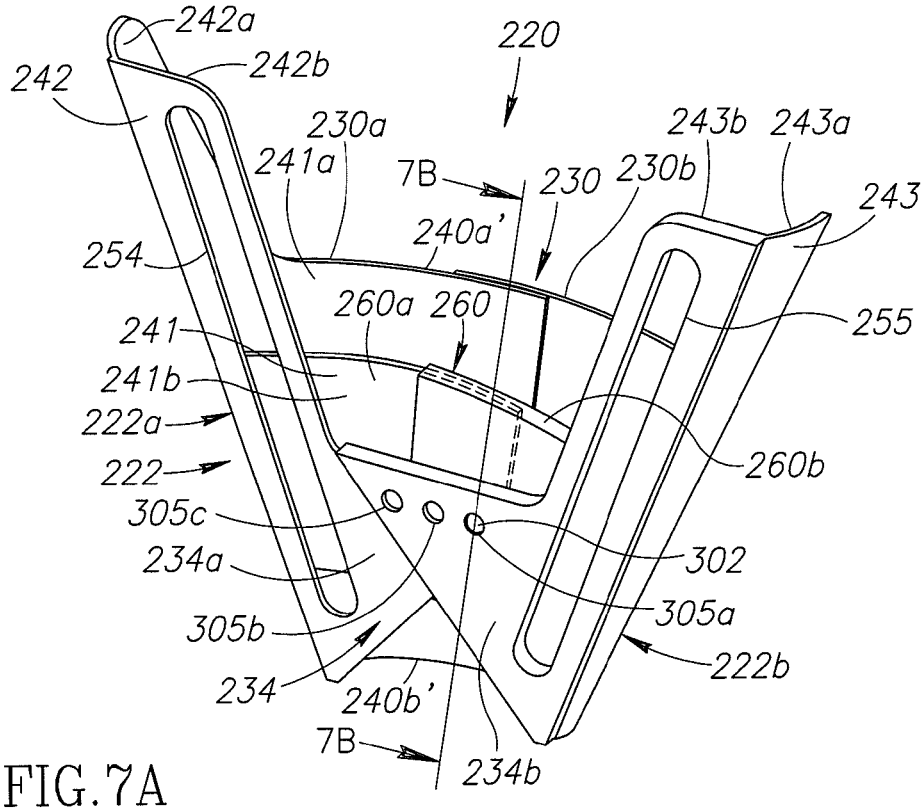
FIG. 7A is a rear perspective view of an alternate apparatus in accordance with the disclosed subject matter.
Figure 7B:
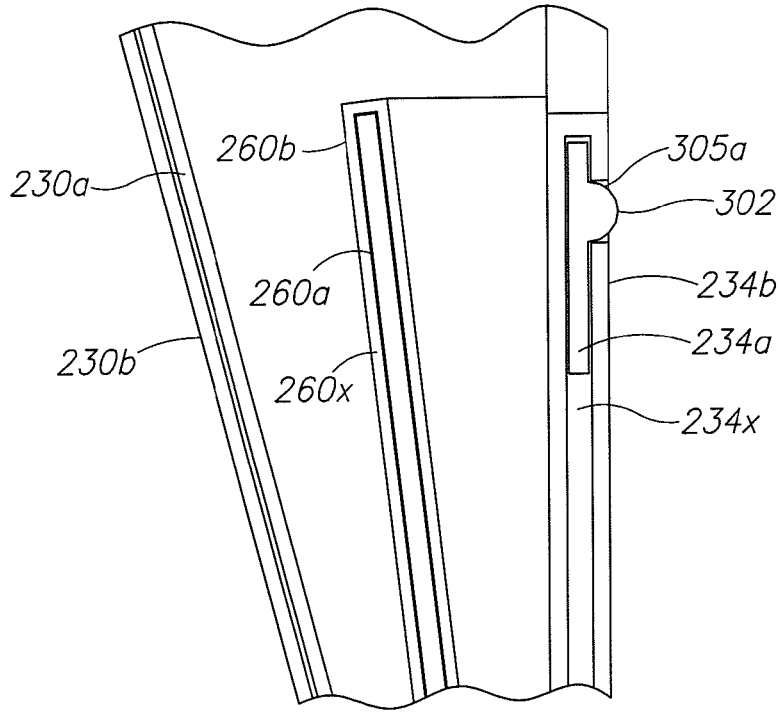
FIG. 7B is a cross sectional view of the apparatus of FIG. 7A taken along line 7B-7B.
Figure 8:
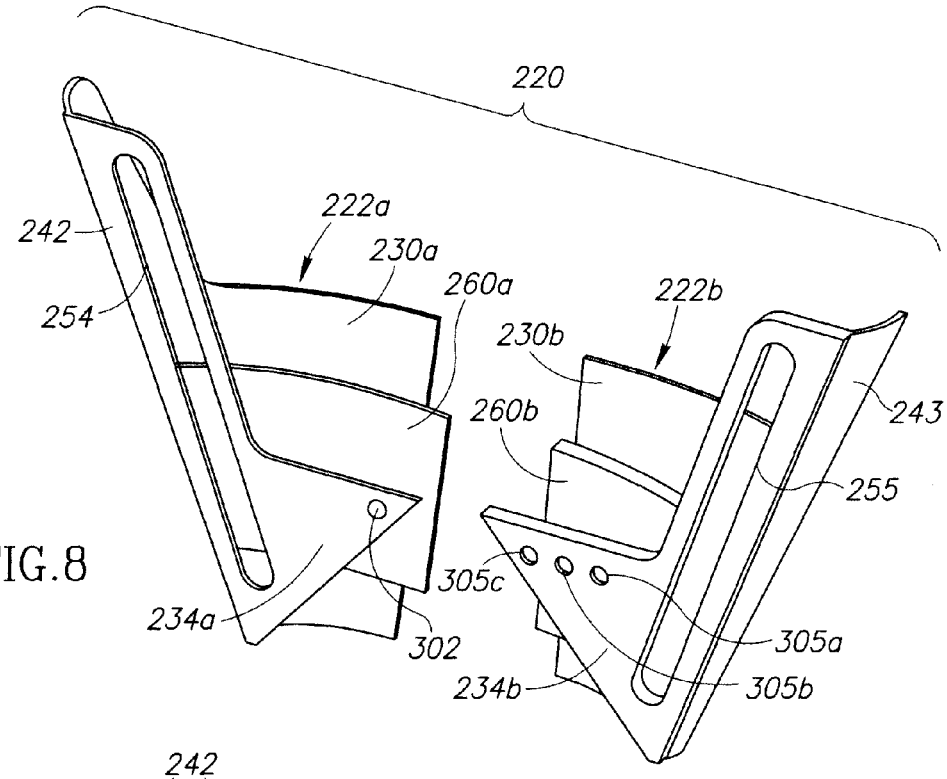
FIG. 8 is an exploded rear perspective view of the apparatus of FIG. 7A.

FIGS. 7A-8 show an alternate apparatus 220, similar to the apparatus 20. Similar components of apparatus 220 to those of apparatus 20 carry the same numbers increased by "200", and the descriptions above are applicable here. Differences, including components unique to this apparatus 220 are detailed below.

In FIGS. 7A, 7B and 8, the apparatus 220 shown is expandable and adjustable, to fit various tie sizes and/or Windsor knot (or other knot) sizes. The body 222 is in pieces or sections, for example, two sections or pieces 222*a* and 222*b* (that accommodate the respective slots 254, 255, for the tie to pass therethrough, through openings 240*a*' and 240*b*', as detailed above). The pieces 222*a* and 222*b* each include front 230, 230*a*, 230*b* and rear 234, 234*a*, 234*b* sides. In the apparatus 220 shown, the front side 230*a* of the first piece 222*a* slides inside of or under the front side 230*b* of the second piece 222*b*. The rear side 234*a* of the first piece 222*a* is slideably received in a slot 234*x* of the rear side 234*b* of the second piece 222*b*. The rear side 234*a* of the first piece 222*a* also includes a protrusion 302, for receipt in openings 305*a*-305*c* (for example, in a snap or other friction fit), to secure engagement of the pieces 222*a*, 222*b*, as further detailed below.

Figure 9:
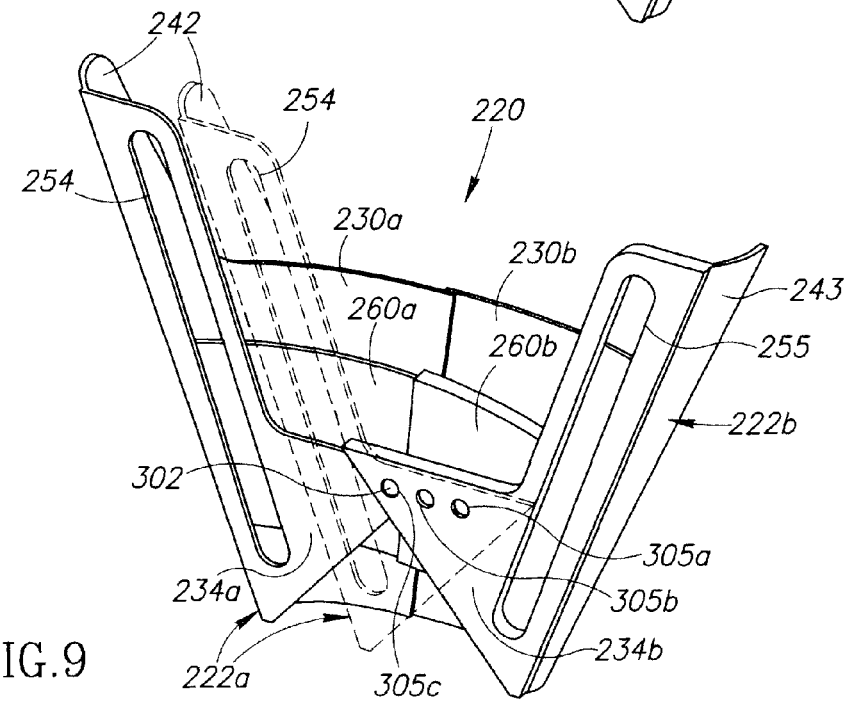
FIG. 9 is a rear perspective view of the apparatus of FIG. 7A showing movement of the pieces that form the apparatus.

The protrusion 302 snap fits or friction fits into the respective opening 305*a*-305*c*, allowing for the pieces 222*a*, 222*b* to be engaged at the desired distance between the lateral edges 242*a*, 242*b* and 243*a*, 243*b* of the arms 242, 243 of the respective pieces 222*a*, 222*b*, to accommodate the desired tie and Windsor knot width. The aforementioned snap or friction fits may be broken as desired, moved to the desired size, with the protrusion 302 reengaged in the desired opening 305*a*-305*c*, when adjustability to another size for the apparatus 220 is desired, as shown in FIG. 9.

While one protrusion 302 and three openings 305*a*-305*c* are shown, any number of openings and/or protrusions are permissible, in any combination, in order to provide the adjustability of the apparatus 220. Alternately, the pieces 222*a*, 222*b* on the rear side 234, that carry the slot 234*x* and openings 305*a*-305*c*, and the protrusion 302, respectively, may be reversed. Also alternately, the front side 230*a* could be arranged to slide outside or over the front side 230*b*.

The dividing member or divider 260 is within the inner cavity 241, dividing the inner cavity into portions 241*a*, 241*b*. Dividing member or divider 260 includes a panel 260*a* on the first piece 222*a*, that is slideably received in a slot 260*x* on a slotted member 260*b* of the second piece 222*b*. The dividing member 260 is, for example, curved. Alternately, the arrangement of the panel 260*a* and slotted member 260*b* could be reversed on the respective pieces 222*a*, 222*b*.

The slots 234*x* and 260*x* of the second piece 222*b*, are of widths to allow for slidability of the rear side 234*a* and panel 260*a*, respectively, on the first piece 222*a*, for example, with some friction therebetween, to minimize play. This minimal play, coupled with the frictional engagement of the front sides 230*a*, 230*b*, as, for example, the front side 230*b* of the second piece 222*b* is designed to force itself against front side 230*a* of the first piece 222*a*, coupled with the engagement of the protrusion 302 in the respective opening 305*a*-305*c*, allows for a firm engagement between the pieces 222*a*, 222*b*, whereby the body 222 and apparatus 220 can support a Windsor knot, as detailed above.

Alternately, the pieces 222*a*, 222*b* on which the protrusion 302 and openings 305*a*-305*c* are positioned, respectively, may be reversed. The aforementioned series of openings and the protrusion (or protrusions as detailed above) could also be on the front sides 230*a*, 230*b* of the pieces 222*a*, 222*b* of the apparatus 220, in any configuration, as detailed above. As a further alternate, the aforementioned series of openings and the protrusion (or protrusions as detailed above) could also be on the front side and rear side of the apparatus, in any of the above described arrangements or combinations thereof.

While preferred embodiments have been described, so as to enable one of skill in the art to practice the disclosed subject matter, the preceding description is intended to be exemplary only. It should not be used to limit the scope of the disclosed subject matter, which should be determined by reference to the following claims.

The invention claimed is:

1. A method for tying of a necktie comprising:

providing an apparatus comprising:

a tubular member including oppositely disposed first and second lateral sides and oppositely disposed front and rear sides;

a first slot in the tubular member at the first lateral side;

a second slot in the tubular member at the second lateral side; and the first slot and the second slot positioned along the rear side of the tubular member; and manipulating a necktie through the first slot and the second slot of the tubular member to create a knot for the necktie supported by the tubular member.

* * * * *